US005104165A

United States Patent [19]

Anderson et al.

[11] Patent Number: 5,104,165

[45] Date of Patent: Apr. 14, 1992

[54] WATER TIGHT COVER FOR LATCH

[75] Inventors: John P. Anderson, Norco; Timothy J. Clavin, Placentia, both of Calif.

[73] Assignee: The Hartwell Corporation, Placentia, Calif.

[21] Appl. No.: 756,836

[22] Filed: Sep. 9, 1991

[51] Int. Cl.[5] ..... E05B 17/18

[52] U.S. Cl. ..... 292/337; 411/431; 70/455; 292/66

[58] Field of Search ..... 292/113, 247, 337, DIG. 31, 292/66; 70/158, 159, 455; 411/372, 373, 377, 431

[56] References Cited

U.S. PATENT DOCUMENTS

| | | | |
|---|---|---|---|
| 3,147,824 | 9/1964 | Henderson | 411/377 X |
| 3,740,981 | 6/1973 | Patriguin | 70/455 |
| 3,797,870 | 3/1974 | Beckman | 292/108 X |
| 4,214,505 | 7/1980 | Aimor | 411/373 |
| 4,693,503 | 9/1987 | Bisbing | 292/DIG. 31 X |
| 4,872,366 | 10/1989 | Appleby et al. | 292/DIG. 31 X |
| 4,925,221 | 5/1990 | Carmody et al. | 292/DIG. 31 X |

*Primary Examiner*—Richard E. Moore

*Attorney, Agent, or Firm*—Harris, Kern, Wallen & Tinsley

[57] ABSTRACT

A cover for a latch or the like mounted at an opening in a panel and comprising a base member and a closure member, with the base member having a bottom and a wall around the bottom, and with the closure member having a gasket, a closed top, and a hinge joining the gasket and top. The base member bottom and the closure member gasket have openings for alignment with the panel opening for receiving the latch and clamping the cover to the panel around the latch, with the base member wall and said closure member top having interengaging lips for holding the closure member top on the base member wall.

4 Claims, 2 Drawing Sheets

WATER TIGHT COVER FOR LATCH

BACKGROUND OF THE INVENTION

This invention relates to covers for panel mounted units such as latches, and in particular to covers which protect the unit from the environment, especially from moisture.

By way of example, latches of various types are widely used for securing doors and access panels in place on structures, such as access doors on equipment housings. One such panel mounted latch is shown in FIG. 1 with a latch 10 carried in a panel 11 for engaging a portion of the structure 12 to secure the panel in place on the structure.

The structures are often exposed to adverse environmental conditions, particularly water, and it is often desirable to provide an arrangement for protecting the latch from water and also having the latch available for actuation. In the past, this has been accomplished by installing gaskets, seals, and O-rings to latch components that allow leakage, such as lock cylinders, pivot pins, rotating shafts, sliding bolts, and actuation handles.

On some latches, such attempts at waterproofing can be very expensive and difficult, if not impossible due to the configuration of the moving components that extend through the outer latch housing. In some cases, the size or shape of the opening changes as the latch is being operated. Such a situation does not lend itself to the use of standard seals and gaskets, so custom sealing membranes or sliding seal arrangements have to be manufactured to make the latch watertight. Usually this makes the latch so expensive that the tendency is to live with a certain amount of leakage, except for applications where full protection from the environment is necessary to prevent damage to mechanical or electrical components within the enclosure.

It is an object of the present invention to provide a new and improved water tight cover which will protect a latch or other unit from moisture and which is inexpensive to manufacture and install and quick and easy to use after installation.

Other objects, advantages, features and results will more fully appear in the course of the following description.

SUMMARY OF THE INVENTION

A cover for a latch or other unit mounted at an opening in a panel and comprising a base member and a closure member, with the base member having a bottom and a wall around the bottom, and with the closure member having a gasket, a closed top, and a hinge joining the gasket and top. The base member bottom and closure member gasket have openings for alignment with the panel opening for receiving the latch and clamping the cover to the panel, with the base member wall and closure member top having interengaging means for holding the closure member top on the base member wall. In the preferred embodiment the interengaging means includes an outer lip on the base member wall and an inner lip on the closure member top, and with the base member of a relatively rigid material and the closure member a single piece of a relatively flexible material.

DESCRIPTION OF THE PREFERRED EMBODIMENT

Figure 1:
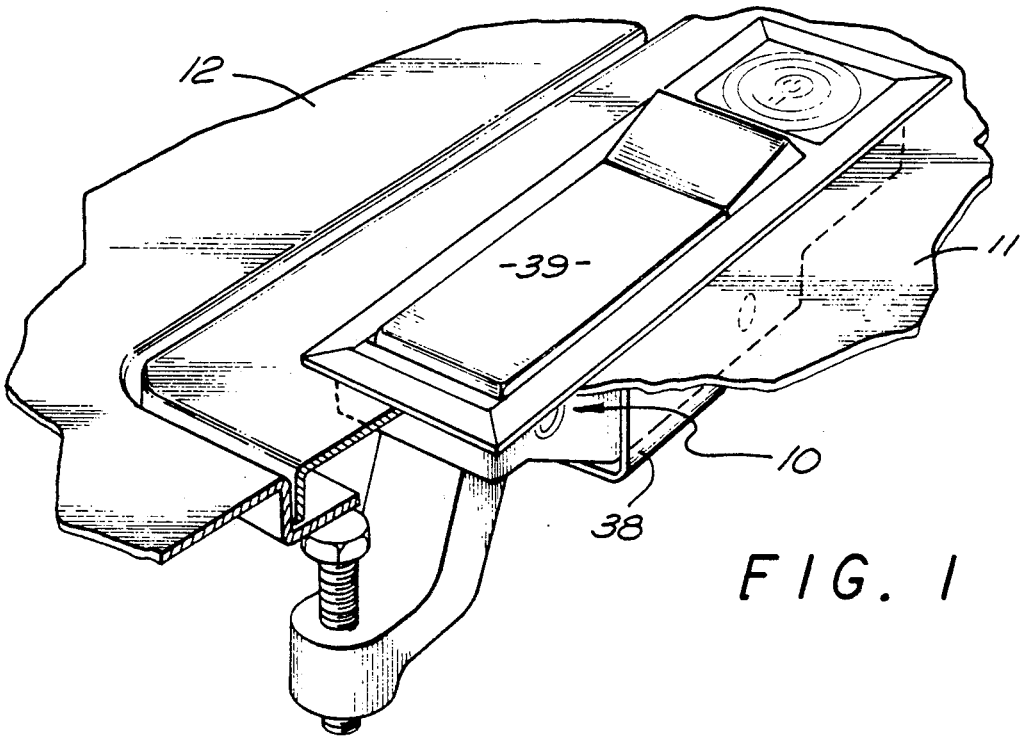
FIG. 1 is a perspective view of a conventional panel mounted latch.

The cover includes a base member 21 and a closure member 22. The base member has a bottom 23 and a side wall 24. The closure member has a gasket 25 and a top 26 joined by a hinge 27. Preferably the base member is made of a relatively rigid material, such as plastic or metal, and the closure member is made of a relatively flexible material, such as rubber or soft plastic An opening 28 in the bottom of the base member is aligned with an opening 29 in the gasket of the closure member Interengaging means are provided on the base member wall 24 and the closure member top 26 for holding the top on the wall. The interengaging means preferably comprises an outer lip 30 around the upper edge of the wall and an inner mating lip 31 around the rim of the top. A ledge or tab 32 may be provided on the top for ease of opening The cover is shown installed along with the latch 10 at an opening 35 in the panel 11. The gasket 25 and the base member 21 are positioned on the panel with the openings 28, 29 and 35 aligned. A frame 36 of the latch is positioned in the aligned openings, with the gasket and base member between the panel and a flange 37 of the latch frame. The top 26 is closed on the side wall 24. The latch and the two cover components are clamped in place by a U bracket 38 and screw 39, as best seen in FIG. 4.

Figure 2:
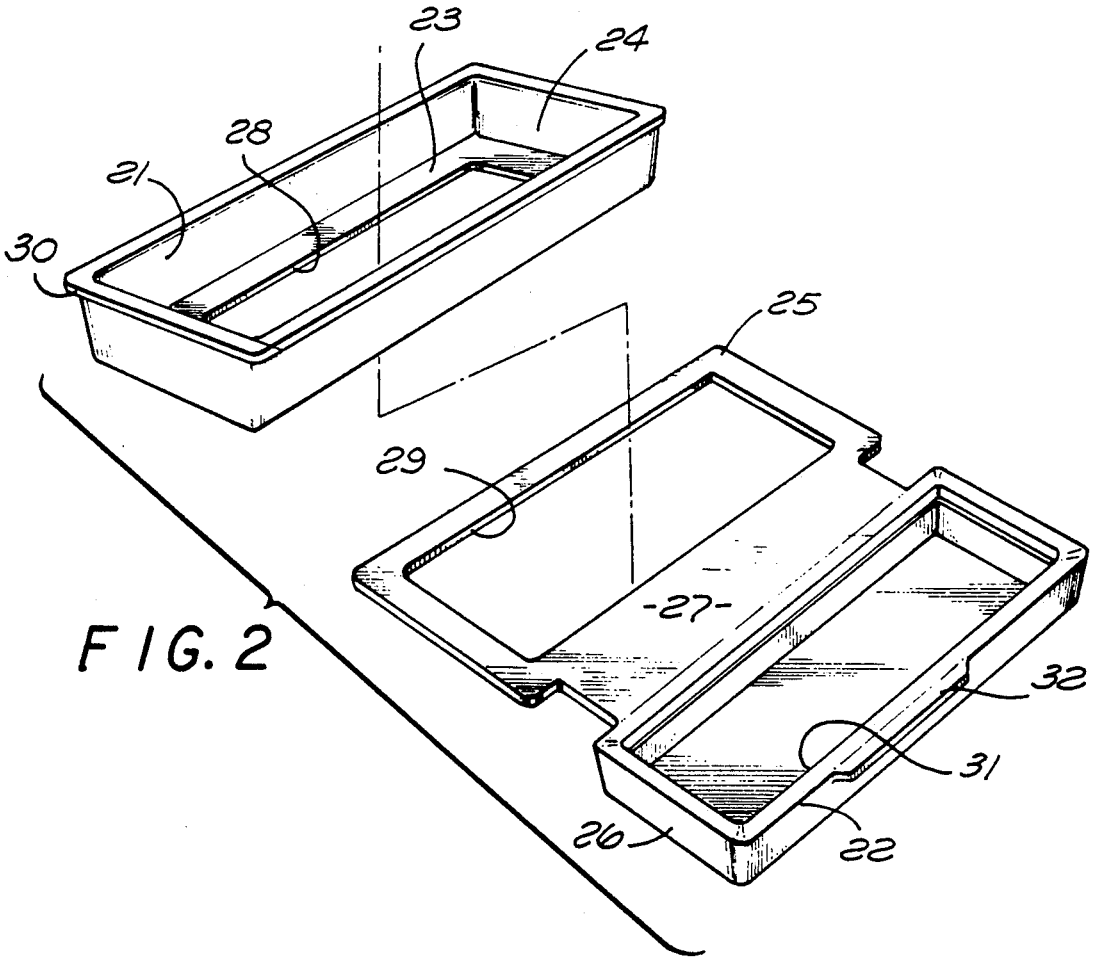
FIG. 2 is a perspective view showing a base member and a closure member of the presently preferred embodiment of the cover of the invention.
Figure 3:
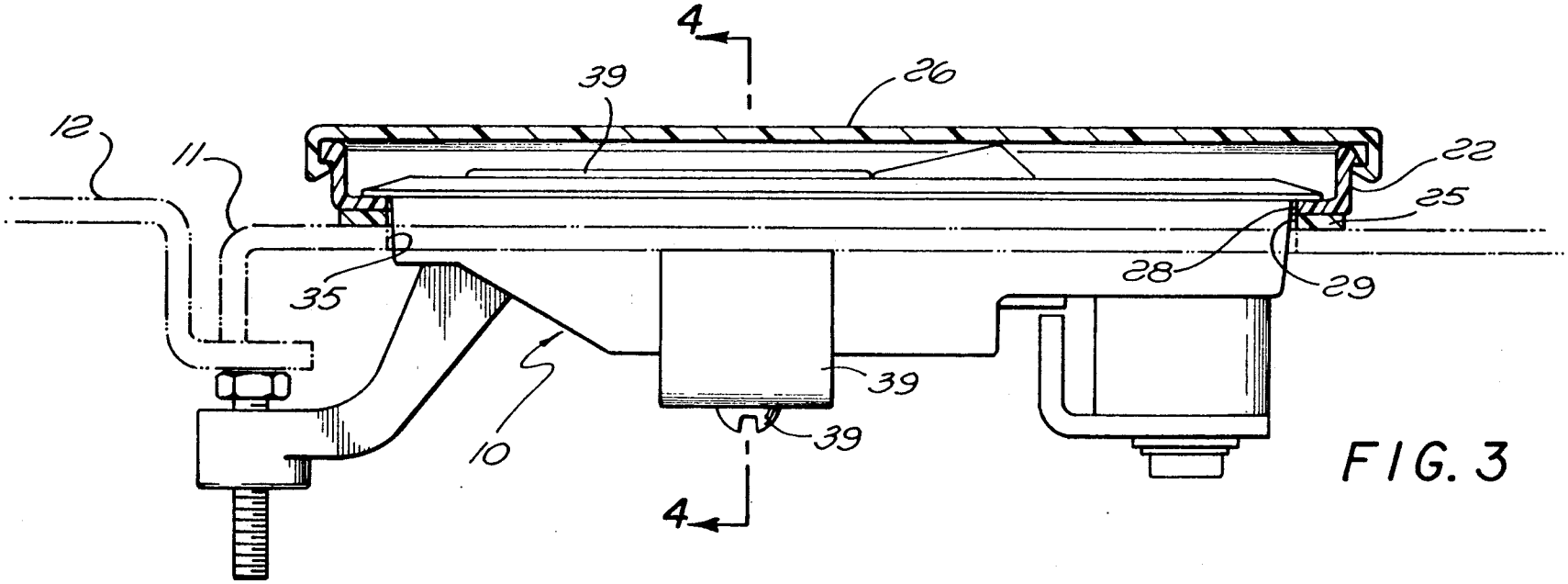
FIG. 3 is a vertical sectional view showing the latch of FIG. 1 mounted in a door panel with the cover of FIG. 2 installed.
Figure 4:
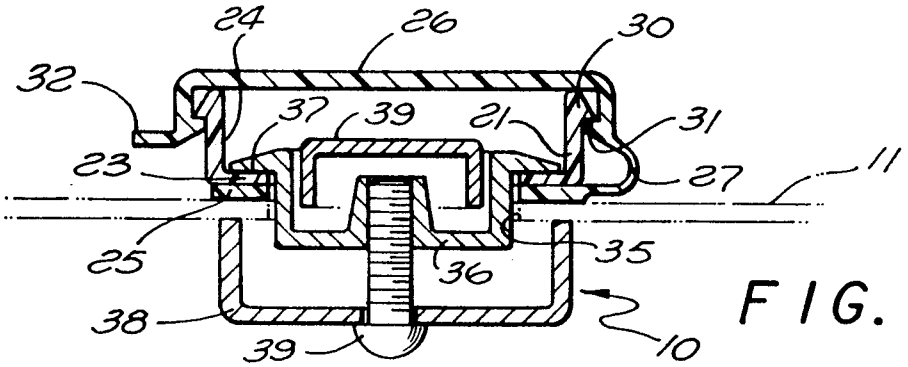
FIG. 4 is a sectional view taken along the line 4—4 of FIG. 3.

The cover is now ready for use The top 26 of the closure member is released from the wall 24 of the base member so that the top can move from the position of FIG. 4 to the position of FIG. 2. This permits access to a handle 39 of the latch. The handle is manually raised, releasing the panel 11 from the structure 12.

The panel is latched in place by closing the panel, pushing the handle 39 down to the position of FIG. 4, and then pivoting the top 26 onto the base member 21 and pushing downward on the top to engage the lips 30, 31. The latch is now sealed by the cover, with the gasket clamped to the panel 11 and with the interengaging lips closing the top.

The cover of the invention not only prevents moisture from entering the enclosure through the latch, but shields the latch itself against corrosion from the environment, thus extending the useful life of the latch. Environmental protection is especially important on boats and docks where the latches are exposed to saltwater, and in cold areas where moisture entering a latch can freeze, making the latch inoperative.

We claim:

1. A cover for a unit mounted at an opening in a panel and comprising a base member and a closure member, said base member having a bottom and a wall around said bottom, said closure member having a gasket, a closed top, and a hinge joining said gasket and top, said base member bottom and said closure member gasket having openings for alignment with said panel opening for receiving said unit and clamping said cover to said panel, said base member wall and said closure member top having interengaging means for holding said closure member top on said base member wall.

2. A cover as defined in claim 1 wherein said interengaging means includes an outer lip on said base member wall and an inner lip on said closure member top.

3. A cover as defined in claim 2 wherein said base member is of a relatively rigid material and said closure member is a single piece of a relatively flexible material.

4. A cover as defined in claim 3 wherein said closure member top has a rim with said lip projecting inward from said rim with said hinge joined to said top at said rim.

* * * * *